US006668596B1

(12) United States Patent
Wagener

(10) Patent No.: US 6,668,596 B1
(45) Date of Patent: Dec. 30, 2003

(54) METHOD FOR PRODUCING A MULTIAXIAL STRUCTURE OUT OF MULTIFILAMENT THREADS

(75) Inventor: Gert Wagener, Emsdetten (DE)

(73) Assignee: Saertex Wagener GmbH & Co. KG, Saerbeck (DE)

( * ) Notice: Subject to any disclaimer, the term of this patent is extended or adjusted under 35 U.S.C. 154(b) by 0 days.

(21) Appl. No.: 09/786,152

(22) PCT Filed: Aug. 18, 1999

(86) PCT No.: PCT/DE99/02611

§ 371 (c)(1),
(2), (4) Date: Feb. 27, 2001

(87) PCT Pub. No.: WO00/14317

PCT Pub. Date: Mar. 16, 2000

(30) Foreign Application Priority Data

Sep. 2, 1998 (DE) ..... 198 39 901
Dec. 4, 1998 (DE) ..... 198 55 941

(51) Int. Cl.[7] ..... D04B 21/14
(52) U.S. Cl. ..... 66/84 A
(58) Field of Search ..... 66/84 A, 203, 66/83, 84 R, 85 R, 85 A

(56) References Cited

U.S. PATENT DOCUMENTS 3,952,550 A * 4/1976 Niederer ..... 66/85 A
4,080,232 A * 3/1978 Friedrich ..... 28/101
4,325,999 A 4/1982 Campman et al.
4,556,440 A 12/1985 Krueger
4,567,738 A * 2/1986 Hutson et al. ..... 66/85 A
4,665,719 A * 5/1987 Naumann ..... 66/84 A
4,741,941 A 5/1988 Englebert et al.
4,872,323 A * 10/1989 Wunner ..... 66/84 A
5,269,863 A * 12/1993 Middelman ..... 66/84 A
5,809,805 A * 9/1998 Palmer et al. ..... 66/84 A
6,151,923 A * 11/2000 Gruenert et al. ..... 66/84 A

FOREIGN PATENT DOCUMENTS

DE 3910245 2/1990
GB 2131839 6/1984

OTHER PUBLICATIONS

Horsting, Karlheinz; "Rationalisierrung Der Fertigung Langfaservestarkter Verbundwerkstoffe Durch Den Einsatz Multiaxialer Gelege", D 82, (Diss. RWTH Aachen), pps. 30–32, Verlag Shaker, Aachen 1994.

Heidelberg, DE, "Multi–Axiale Kettengewirke Als Textile Verstarkung In Faservebundwekstoffen"XP 0000262881236 *Melliand Textilberichte International Textile Reports*, Feb. No. 2, pps. 109–112, 70 1989.

* cited by examiner

*Primary Examiner*—Danny Worrell
(74) *Attorney, Agent, or Firm*—Merchant & Gould P.C.

(57) ABSTRACT

The invention relates to a method for producing a multiaxial structure out of multifilament threads which are superimposed with different orientations. The threads of the 0° position run in a direction of production and are inserted between the remaining multifilament layers superimposed with different orientations. In addition, the threads of the 0° position are guided in the area located in front of the stitch bonding machine by auxiliary means which ensure the correct superimposition or distribution thereof.

8 Claims, 1 Drawing Sheet

FIG. 1
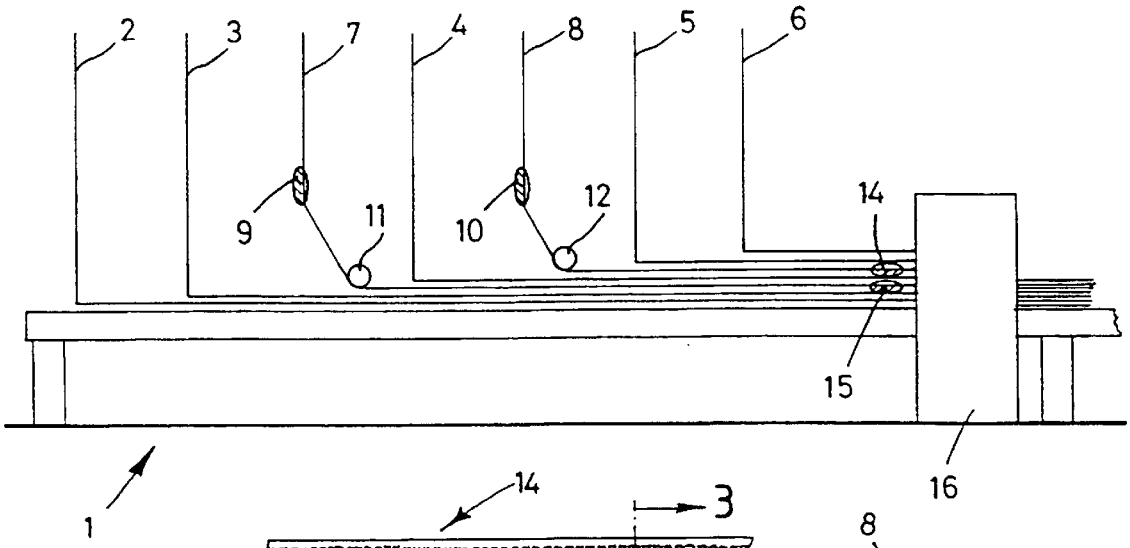
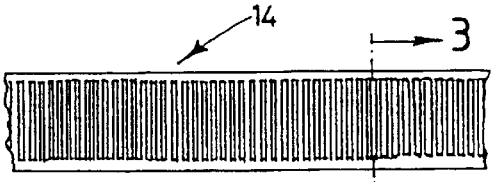
FIG. 2
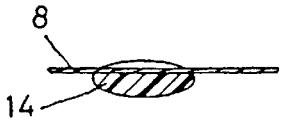
FIG. 3
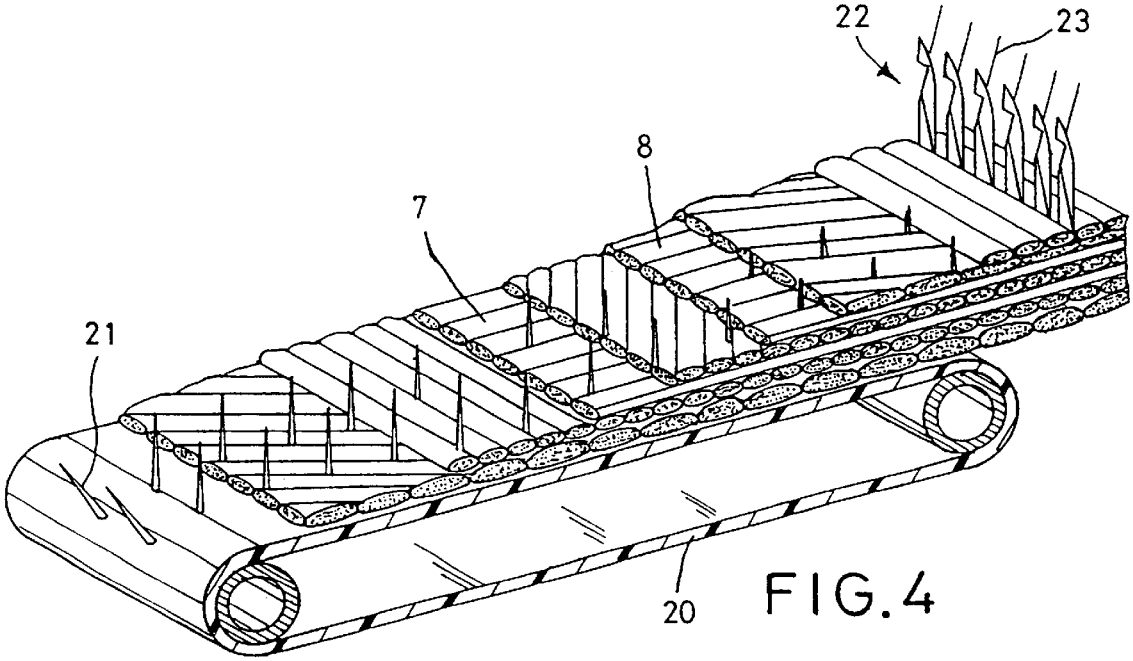
FIG. 4

METHOD FOR PRODUCING A MULTIAXIAL STRUCTURE OUT OF MULTIFILAMENT THREADS

The invention relates to a method for producing a multiaxial structure out of multifilament threads according to the precharacterizing clause of the main claim.

1. Field of the Invention

A device for producing a multiaxial structure out of multifilament thread has been known, for example, from the piece in the literature "Rationalisierung der Fertigung langfaserverstärkter Verbundwerkstoffe durch der Einsatz multiaxialer Gelege" ["Rationalization of the production of long-fiber-reinforced composite material through the application of multiaxial structures"] by Karlheinz Höbrsting, Verlag Shaker, Aachen 1954, in particular pages 30 and 32.

2. Background of the Invention

The manner of functioning of such a machine shall be briefly described in the following, in order to improve the understanding of the invention:

The multifilament threads are drawn from bobbin creels and fed to weft iserton carriages that move on adjustable rails ad place the multifilament threads, in the required orientation of ±25° to 90°, into a so-called needle-transport chain. On each weft insertion carriage the density of the supplied threads can be set by means of a reed comb, thus determining the weight per $m^2$ of the individual layers. For the exact inlaying of the needle-transport chains, the weft insertion carriage swings out over the transport chain in the edge region. Upon barking at the reversal point, the excess-supplied material is compensated though a thread storage device. Through an appropriate movement the multifilament threads are pressed behind the needles of the transport chain. In order to ensure a parallel laying down of the multifilament threads, the combs of the weft insertion carriage performs an offsetting movement in the production direction, corresponding to the strip width of the threads. After the offsetting movement, the weft insertion ends carriage and travels toward the opposite side of the structure.

Through the sequential operation of several weft insertion systems, the structure is then stratified in different orientations.

The 0° filaments-which thus extend in the production direction are inserted directly from a warp beam or an additional bobbin creel immediately in front of a knitting or stitching machine.

The loose thread structure is fixed by means of a conventional knitting or stitching machine. Subsequently the edge regions of the structure, which lie in a transport chain, are then cut off, since thread damage to tight filament curvatures is present here. The finished multiaxial structure is then wound onto a cloth roller.

The weft multifilaments are laid down, at an angle of ±22.5° to ±60° and more, seen in the production direction and in a 90° direction, while the so-called warp threads are fed in the 0° direction, i.e. parallel to the production direction.

At present the so called multifilaments of the 0° layer always form the top layer of the completed multiaxial.

Such multiaxial structures frequently consist of multifilaments produced from which are highly sensitive to bending and fracture, and if the 0° multifilaments are arranged in the top layer the winding of the finished structure onto the cloth roller leads, to an overstressing of the fibers of these multifilament threads. Thus, in the case of a multiaxial structure composing a multiplicity of individual layers, for example six or seven layers, until now the following procedure was followed: one produced structures with, for example, three layers, in which the 0° multifilaments were also arranged in the topmost layer, and then turned around one of these structures, so that then two structures were superimposed, in which the 0° multifilaments were arranged in the middle, thus theoretically in the so-called neutral zone; then, these structures, already stitched once, were stitched a third time, i.e., the two structures had to be stitched together. This led to the fact that through the several courses of stitching additional damage occurred to the fibers of the multifilaments.

SUMMARY OF THE INVENTION

From DE 39 10 245 A1 has been known a process and a device for producing a thread lattice. In order to achieve an extensive isotropy of the thread lattice, it is here proposed that, above, below, or between the individual groups of the threads that are already laid down and run in the transverse direction as well as the in the diagonal direction, in addition threads be introduced in the longitudinal direction. The supplying of the longitudinal-direction, thus the 0° threads, immediately in front of the stitching location is not possible when the 0° threads are to be laid between the individual cross-threads. These 0° threads, supplied at any location whatever, do not, however, retain their aimed-for position and desired distribution, but rather shift, so that different thicknesses and thus different strengths, considered in the transverse direction of the structure, necessarily come about.

The object of the invention is to create a multiaxial structure in which it is possible to supply the 0° multifilaments threads at any location of the structure, to secure their predetermined position, and in spite of this to produce a structure that is composed, for example, of seven layers, but needs to be stitched only a single time.

This object of the invention is achieved through the teaching of the main claim.

Thus, proposed is a multiaxial structure with, for example, seven layers, in which the 0° layers can be worked in between the other ±22.5° to 90° layers, and are held secure in their aimed-for alignment, position, and distribution.

BRIEF DESCRIPTION OF THE DRAWINGS

FIG. 1 is a schematic representation of a stitching or knitting machine for producing a multiaxial structure.

FIG. 2 is one view of a reed comb.

FIG. 3 is a sectional strip according to the line 3—3 in FIG. 2.

FIG. 4 is one view of a modified embodiment of the invention.

DETAILED DESCRIPTION OF THE INVENTION

According to an essential proposal of the invention, provision is here made for the fact that the 0° layers are fixed in their predetermined distribution between their point of introduction and the stitching or, as the case may be, are taken back to their aimed-for distribution position, by free-floating combs arranged in front of the stitch location. Thus, for example, it is possible to produce a structure that is composed of the following thread layers:

1. a thread layer of −/+45° multifilament threads
2. a thread layer of +/−45° multifilament threads
3. a thread layer of 0° multifilament threads 4. a thread layer of +90° multifilament treads
5. a thread layer of 0° multifilament treads
6. a thread layer of +/−45° multifilament treads
7. a thread layer of −/+45° multifilament threads The free-floating combs secure the correct positioning of the 0° multifilament threads in front of the stitching or knitting machine, even if these multifilament threads would be displaced by the placing down of the following multifilament threads placed by the weft insertion carriage in a different orientation, and are id to the stitching location secured in their spacing with respect to each other.

Another possible embodiment form of the invention consists in the fact that the 0° multifilaments are supported and led up to the stitching location by conveying means circulating the conventional needle. These conveying means can be designed as a conveyer belt and can be equipped with a multiplicity of fine needles that ensure, up to the stitching location, the retaining of the distribution of all of the layers as predetermined when placed into the needle chain. In this, care is to be taken that the 0° multifilaments do not become bound into the needle-transport chains, but rater are placed down, in an essentially free-floating way, upon the already-placed weft threads tied into the needle-transport chain, but are held in a position—and distribution-secure manner by the fine needles of the conveyer belt. As a conveying means, a conveyer belt or an endless feed lattice or a fabric belt can here be used.

However, it is also conceivable, that the individual thread layers are placed down on a plane independently of their orientation and in addition to the weft threads held in the needle-transport chains, which plane holds fixed the multifilament threads by virtue of a vacuum prevailing at the surface of this plane and of the suction pressure acting on the structure, and leads the latter up to the stitching location.

Finally, it is also possible that at least the threads of the 0° layer are secured positionally and/or distributionally in their arrangement in a material-securing, i.e. form-fitting, manner. Here, the threads of the 0° layer can be joined to each other in an interlocking manner or to at least one of the multifilament-thread layers aligned in different orientations. The material interlocking positional and/or distributional securing can take place through the spraying an adhesive onto, or moistening, the 0° threads; these threads then adhere to each other or to the neighboring multifilament-thread layer. It is also possible to effect a themeo-fixing, which of course requires the use of a thermoplastic material, which is brought in as a supplement in a powder form or with which the threads of the 0° layer are coated or with which the threads of the adjacent multifilament-thread layers are coated.

Thus, achieved through the proposal(s) according to the invention is the fact that damage to the individual multifilament threads through multiple stitchings, whether it is a matter of threads in the ±22.5° to 90° layer or threads in the 0° layer, is avoided, since only a onetime stitching-together of the multiplicity of individual thread layers must take place. Through this, not only is damage avoided, but also considerable costs are spared for the handling of the structure and the distribution of the 0° threads in the region of the stitching location is completely secured.

According to the invention, the 0° warp-thread filaments can be arranged at any layer height of the structure whatever, so that the structure can be adapted in a better manner to the requirements presented with respect to tensile strength. The fixing of the 0° warp-thread filaments is secured from the entry point up to the stitching location—but in any case immediately in front of the stitching location. These aimed-at advantages are in particular of especially great importance when the multifilament threads are completely or partially formed of carbon fibers.

An embodiment example of the invention is explained in the following with the aid of the drawings. These show:

Shown in FIGS. 1 through 3 is a stitching or knitting machine 1 for producing g multiaxial structure. Represented b 2, 3, 4, 5, and 6 are the weft insertion systems for the +/−24° to 90° threads, and by 7 and 8 the thread feeds running in the 0° layer.

Inserted into these feeds of the 0° threads are combs 9 and 10, and the threads are lead via deflector rollers 11 and 12 into the structure.

Immediately in font of a stitching location 16 are inserted into the structure free-floating combs 14 and 15, which are held in their position between the multifilament threads brought in through the weft insertion systems 2, 3, 4, 5, and 6. Thus, for example, these combs 14 and 15 can be held by threads, ropes, or wires, which are arranged locationally-fixed upon the starting of the machine.

FIG. 2 shows a view of a reed comb, for example the free-floating comb 14, and FIG. 3 shows how the multifilament thread 8 introduced into the 0° position is guided in this comb.

Even if the 0° multifilament 7 has been displaced or is no longer correctly aligned positionally between the threads introduced at +/−25° to 90° in its path from the introduction point up to the stitching location 16, or is no longer correctly aligned in its position, the 0° multifilament thread 7 is once again led back into its aimed-for position through the free-floating comb 15, and the 0° multifilament threads are again aligned in the desired distribution immediately in front of the stitching location 16, so that the stitching together and thus the fixing of the collective structure takes place so that all of the assume the desired position.

Recognizable in the embodiment from according to FIG. 4 is a circulating conveyer belt 20, on which are arranged multifilament threads in the +/−25° to 90° layer; between these threads, 0° multifilament threads 7 and 8 are indicated. While the weft threads laid down in the production direction at an angle of +/−22.5° to 90° are essentially secured in their position by the needle-transport chain, they are in addition secured in their position and distribution by the needles 21 arranged on the conveyer belt 20. In FIG. 4, these needles are represented in an exaggerated manner with respect to size and the distance between them, in order to make the invention more clear. In practice, it is a matter here of fine needle bars or needle beams, the needles being very fine and arranged at a very much shorter distance apart from each other.

However, FIG. 4 should decisively illustrate the fact that the 0° multifilament threads 7 and 8 are prevented by these needles 21 from becoming displaced transversely to the conveyer belt 20 and are consequently fed to the stitching location in a positionally- and distributionally-secured manner, which stitching location is represented in FIG. 4, also purely schematically, at 22. Indicated with 23 in FIG. 4 are the stitching or warp-threads, which are drawn by the needles 22 into the structure and thereby stitch together the structure, which is then led to a cloth roller not illustrated in the drawings.

What is claimed is:

1. A method for producing a multiaxial structure out of multifilament threads that are superimposed in different orientations comprising the steps of:

placing at least one multifilament thread layer;

placing at least one 0° layer, wherein the 0° layer comprises multifilament threads at 0° to the production direction in between the at least one multifilament thread layer, wherein the at least one multifilament thread layer has a different orientation than the 0° layer; and guiding the 0° layer and the at least one multifilament thread layer having a different orientation in front of a stitch knitting machine through use of position securing means, distribution securing means, or a combination thereof, wherein the multiaxial structure need only be stitched once.

2. A method for producing a multiaxial structure out of multifilament threads that are superimposed in different orientations comprising the steps of:

placing at least one multifilament thread layer;

placing at least one 0° layer, wherein the 0° layer comprises multifilament threads at 0° to the production direction in between the at least one multifilament thread layer, wherein the at least one multifilament thread layer has a different orientation than the 0° layer;

guiding the 0° layer in front of a stitch knitting machine through use of position securing means, distribution securing means, or a combination thereof; and fixing the orientations of the 0° layer in an introduction region, before feeding the multifilament threads of the multiaxial structure to a stitch-knitting machine, wherein the stitch-knitting machine knits the multiaxial structure together, using free-floating reeds.

3. A method for producing a multiaxial structure out of multifilament threads that are superimposed in different orientations comprising the steps of:

placing at least one multifilament thread layer;

placing at least one 0° layer, wherein the 0° layer comprises multifilament threads at 0° to the production direction in between the at least one multifilament thread layer, wherein the at least one multifilament thread layer has a different orientation than the 0° layer;

guiding the 0° layer in front of a stitch knitting machine through use of position securing means, distribution securing means, or a combination thereof; and placing the multiaxial structure onto a conveying means running in the production direction, wherein the conveying means is equipped with a multiplicity of thin needles that secure, the distribution of all the layers of the multiaxial structure when they are placed onto the conveying means, and wherein the multiplicity of needles secure the 0° layer before the multifilament threads of the multiaxial structure are fed to the stitch-knitting machine to stitch the structure together.

4. The method according to claim 3, wherein the conveying means comprises a circulating conveyer belt.

5. The method according to claim 3, wherein the conveying means comprises an endless feed lattice.

6. The method according to claim 3, wherein the conveying means comprises a fabric belt.

7. The method according to claim 3, wherein all of the multifilament threads of the axial structure, are laid down upon a plane surface that is subjected to an underpressure.

8. The method according to claim 1, wherein at least the multifilament threads of the 0° layer are secured in the position, distribution, or a combination thereof in a material-interlocking manner with themselves or with at least one of the multifilament-thread layers aligned in different orientations.

* * * * *